United States Patent [19]

Ecclestone

[11] Patent Number: 4,801,023

[45] Date of Patent: Jan. 31, 1989

[54] MODULAR DISPLAY AND STORAGE UNIT

[75] Inventor: James A. Ecclestone, Don Mills, Canada

[73] Assignee: Calstone Inc., Scarborough, Canada

[21] Appl. No.: 17,679

[22] Filed: Feb. 24, 1987

[30] Foreign Application Priority Data

Oct. 17, 1986 [CA] Canada ..... 520709

[51] Int. Cl.[4] ..... A47F 7/00

[52] U.S. Cl. ..... 211/55; 211/128

[58] Field of Search ..... 211/128, 50, 162, 55, 211/94, 94.5

[56] References Cited

U.S. PATENT DOCUMENTS

| | | | |
|---|---|---|---|
| D. 176,418 | 12/1955 | Koval | D80/9 |
| 939,807 | 11/1909 | Collins | 211/55 X |
| 2,108,122 | 2/1938 | Hall | 211/126 |
| 2,316,892 | 4/1943 | Saul, Jr. | 211/128 |
| 3,298,538 | 1/1967 | Ganz et al. | 211/55 X |
| 3,892,450 | 7/1975 | Kolster et al. | 211/55 X |
| 4,062,452 | 12/1977 | Bartholomew | 211/55 |
| 4,613,047 | 9/1986 | Bushyhead et al. | 211/55 |

FOREIGN PATENT DOCUMENTS

| | | |
|---|---|---|
| D 39309 | 6/1975 | Canada . |
| D 39878 | 11/1975 | Canada . |
| D 57269 | 10/1986 | Canada . |

*Primary Examiner*—Reinaldo P. Machado
*Assistant Examiner*—Sarah A. Lechok Eley
*Attorney, Agent, or Firm*—Weldon F. Green

[57] ABSTRACT

A composite display and storage unit suitable for the display and storage of merchandise including greeting cards, stationery, wrapping paper and the like wherein modules in the form of shelf-like elements are removably attached to an upstanding support structure on a base structure or pedestal to project outwardly therefrom. Modules adapted for greeting cards and like merchandise comprise a trough-like outer end portion for display of merchandise, a intermediate repository portion extending inwardly therefrom for storage of backup inventory and an inner anchoring portion adapted for attachment to the upstanding support structure, and include dividing elements for supporting the next higher module and selectively determining compartment sizes. Modules adapted for wrapping paper and the like comprise a shelf-like element having an outer barrier, a repository portion and dividing elements affixed thereto. The upright support structure supports the inner end of the modules while the dividing elements transmit support from the forward extent of the base structure or pedestal to the outer portions of the modules.

23 Claims, 7 Drawing Sheets

MODULAR DISPLAY AND STORAGE UNIT

FIELD OF INVENTION

This invention relates to improvements in a composite unit for the display and storage of merchandise such as greeting cards, stationery, wrapping paper, or other like or associated items.

More particularly, this invention relates to improvements in a composite knockdown display and storage unit, wherein such merchandise is displayed for inspection or viewing and selection in an arrangement of tiers or in banks of shelves or pockets, and the inventory or backup stock stored in close proximity thereto within the supporting framework or the base.

BACKGROUND OF THE INVENTION

Display and storage units of the type under consideration normally present a series of fixed shelves which are arranged in stepped fashion upon which greeting card merchandise or the like is deposited in separated upright disposition for display and viewing and for easy inspection and selection, which units usually include a large base or enclosure with drawers or compartments for storing the inventory or backup stock of such merchandise.

When the merchandise on display on the shelves or in the pockets has been exhausted the shelves or pockets must be replenished, requiring the clerk to first identify the exhausted item or items, locate the backup stock within the lower storage drawers or compartments or elsewhere, and then withdraw, deposit and arrange same upon or within the overlying shelves or pockets.

The steps of identifying, then locating, selecting and setting up greeting cards or other like items for display purposes are time consuming and regarded as an inconvenience likely to interfere with customers viewing or inspecting such merchandise, giving rise to inefficiencies and possible losses of sales especially when the displayed items have been exhausted.

More particularly, such display units are usually of wooden construction of fairly large proportions and weighty, and therefore costly to manufacture and ship, as well as cumbersome to install or relocate within the premises as may be required from time to time.

Greeting cards, wrapping paper and other like merchandise are produced in a wide variety of sizes or dimensions, and, where shelves are fixed and not adjustable, the manner in which they can be presented for viewing is limited by the extent of the shelf space or any fixed dividers or pockets that are employed, as well as by the vertical separation of the shelves or pockets.

Accordingly, such display units limit the manner in which cards or other like merchandise can be displayed, and therefore limit the advantages to b derived from such a promotion.

According to the prior art, certain alternatives or modifications have been suggested to alleviate one or more of these problems.

For example U.S. Pat. No. 2,304,756 of Ames et al discloses a combination display and storage cabinet. Display cards are mounted upright for easy viewing by customers with reserve stock located in storage compartments behind the display cards but separated behind a series of sliding doors. While the cabinet of Ames et al includes a series of dividers between the storage compartments the variability of width of these dividers is limited to a considerable extent to the width of the door in front of it. Thus, if a change of width is required in any one of the compartments, a different size door would have to be installed. This limits the versatility of the storage space.

Also, the cabinet described in this reference is of a somewhat elaborate construction and not easily assembled nor disassemble d for storage.

U.S. Pat. No. 1,568,729 of Gearon describes a cabinet wherein post cards and the like are displayed in an upright position with reserve stock stored directly behind the display. Such cabinet does not allow for any variation in the size of the storage compartment. Cards are stored in rectangular boxes which fit onto the shelves, and the display card is mounted on the shelf access door immediately in front of the storage box. Not only does this cabinet not permit variation in storage or display area but is of a solid construction and cannot be easily disassembled.

U.S. Pat. No. 3,667,826 of Wood et al describes a display and storage unit which permits some modification in the display of various goods but does not permit the easy upright display of cards or stationery wherein a supply of replacement cards can be deposited directly behind the display for easy access.

U.S. Pat. No. 3,892,450 to Kolster et al describes a display and storage rack wherein the storage areas are located directly behind the display racks. In this unit, however, the display rack must be pivoted outwardly in order to gain access to the storage area and each individual display and storage unit requires a relatively intricate mounting.

The suggested alternatives or modifications of the prior art appear complicated and if constructed would likely entail considerable cost in their manufacture, especially in the case where some moving parts are utilized to permit access to the storage compartments.

Moreover such units are obviously quite difficult to assemble and rearranged and for the most appear to accommodate the wide range of sizes and shapes of merchandise that is produced for display and sale.

OBJECTS OF THE INVENTION

It is therefore an important object of one aspect of the invention to provide a module for the combined display and storage of merchandise, which is adopted for attachment to an upstanding support formation to project outwardly therefrom, an inner end portion including anchoring means for attachment to said support formation and an outer end portion including barrier means for confining merchandise thereto for display and inspection, and an intermediate repository portion for supporting merchandise thereon for storage and extending above said carrier means from said outer end portion towards said inner end portion and accessible from said outer end portion.

It is an important object of another aspect of this invention to provide in a unit for the combined display and storage of merchandise which is adapted for attachment to an upstanding support formation to project outwardly therefrom, the combination with a module having an inner end portion including anchoring means for attachment to said support formation and an outer end portion including barrier means for confining merchandise thereto for display and inspection and an intermediate repository portion for supporting merchandise thereon for storage extending from said outer end portion towards said inner end portion and accessible over said outer end portion and divider means adapted to extend inwardly from said outer end portion over said repository portion and to upstand therefrom in an aligned position therewith and shiftable thereover throughout a range of said aligned positions, and means presented by said divider means to said module for releasably engaging said upstanding module for maintaining said divider means in said upstanding aligned positions thereover and guiding same when shifted throughout said range of aligned positions.

Still another very important object is to so arrange the supporting shelf-like modules for display and storage wherein replacement from backup stock involves minimal handling, and wherein the overall time for servicing of such unit is reduced, and therefore efficiency and profitability is much improved.

Moreover, it is a very important consideration that the amount of backup stock or inventory can be readily ascertained by visual inspection of the unit as it stands, which further enhances the overall efficiency of the merchandising operation.

Still another important object is to provide a display and storage unit that is relatively lightweight, constructed from selected modules so that manufacturing and shipping costs can be kept low and the labour required and time involved in assembling and installing or relocating such unit is kept to a minimum.

FEATURES OF THE INVENTION

One important feature of this invention resides in providing a shelf-like element or module having an inner end adapted for attachment to an upstanding support formation to extend outwardly therefrom to an outer end upon which merchandise is to be disposed or mounted for display, and a repository portion extending inwardly therefrom towards the inner end upon which the backup inventory can be stacked or otherwise arranged.

More particularly, it is a feature to provide such a shelf-like element or module wherein a barrier is presented to project upwardly to a limited extent in the region of the outer end to receive the lowermost portion or edge of the merchandise to be displayed therebehind and thereby hold same from below against dislodgement.

Still more particularly, in the case of greeting cards, stationery or other similar merchandise, it is a feature of this invention to utilize a plurality of such shelf-like elements having the aforementioned characteristics releasably mounted or anchored to extend outwardly from an upstanding support formation in spaced apart overlying relation of a selected extent generally corresponding to the extent of the card or cards to be displayed and with the overlying shelf-like element offset rearwardly in relation to the underlying shelf-like element so that the greeting cards with their lowermost portions or edges registering behind the barrier presented by the lower shelf-like element incline upwardly and rearwardly with the uppermost portion thereof engaging against the foremost outer barrier surface of the overlying shelf-like element and so expose a maximum of the front face of such card to view, as well as permit ready retrieval of same therefrom for inspection and purchase or replacement.

Further, such an arrangement minimizes unnecessary handling of the back-up.

Still another important feature resides in providing displaceable interengageable divider elements in conjunction with the aforementioned shelf-like elements so as to establish pockets or bins of selected widths extending rearwardly from the region of the barrier to accommodate the varying widths of the greeting cards or like merchandise displayed behind the barrier and thereby more effectively utilize the available shelf space for both display and storage.

It is also an important feature to utilize such interengageable divider element as an additional forwardly located support for the overlying separated shelf-like element to extend upwardly from the outer end region of the lower shelf-like element to engage and support the next overlying rearwardly offset shelf-like element from below in the region of the barrier.

Another feature of this invention resides in providing a composite display and storage unit wherein the base thereof is of substantial proportions to give stability as well as to serve as an ample housing or enclosure for drawers or compartments for additional inventory or stock from which the support structure for the shelf-like elements upstand in the rearward region thereof, such support structure presenting an upwardly and rearwardly inclined forwardly facing anchoring surface above the forwardly disposed portion of the base over which the shelf-like elements are releasably anchored or secured either in tiers or in banks or in other selected patterns, with such support surface having an inclination so as to automatically achieve the inclined or stepped arrangement of the shelf-like elements needed to expose the displayed as well as stored greeting cards or like merchandise to optimum viewing.

More particularly the overall objects of this invention are achieved by providing a composite display and storage unit which includes in combination a lightweight base with an upstanding framing member that includes a support formation inclining upwardly rearwardly from the base presenting spaced apart anchoring stations for the reception and attachment of shelf-like modules in cantilever-like fashion, each of the modules having:

(i) an inner end portion adapted for releasable attachment to the support structure and extending outwardly therefrom for supporting disposed display merchandise and storage merchandise thereon, (ii) an outer end portion including a region for confining merchandise for display and inspection and a barrier confining same against dislodgement, (iii) an intermediate repository portion extending inwardly of the barrier for supporting merchandise thereon and being accessible from said outer end portion, (c) a divider positioned along the repository portion of said underlying module to provide a display and storage separation therefore and extending upwardly to the overlying module to maintain the underlying and overlying modules in substantially uniform spaced apart relation.

Another aspect of the invention for achieving such objects resides in providing a module for a display and storage unit, said module having:

(a) an inner end portion adapted for attachment to an upstanding support formation and projecting outwardly therefrom for supporting disposed display merchandise and storage merchandise;

(b) an outer end portion including a barrier means for supporting said display merchandise for inspection and confirming same against dislodgement; and (c) an intermediate repository portion extending inwardly of said barrier means to said inner end for the support and storage of said storage merchandise and accessible from said outer end.

DETAILED DESCRIPTION OF THE INVENTION

Particular embodiments of the invention are described below and which are to be read in conjunction with the drawings illustrating same, wherein.

DESCRIPTION OF THE INVENTION

Figure 1:
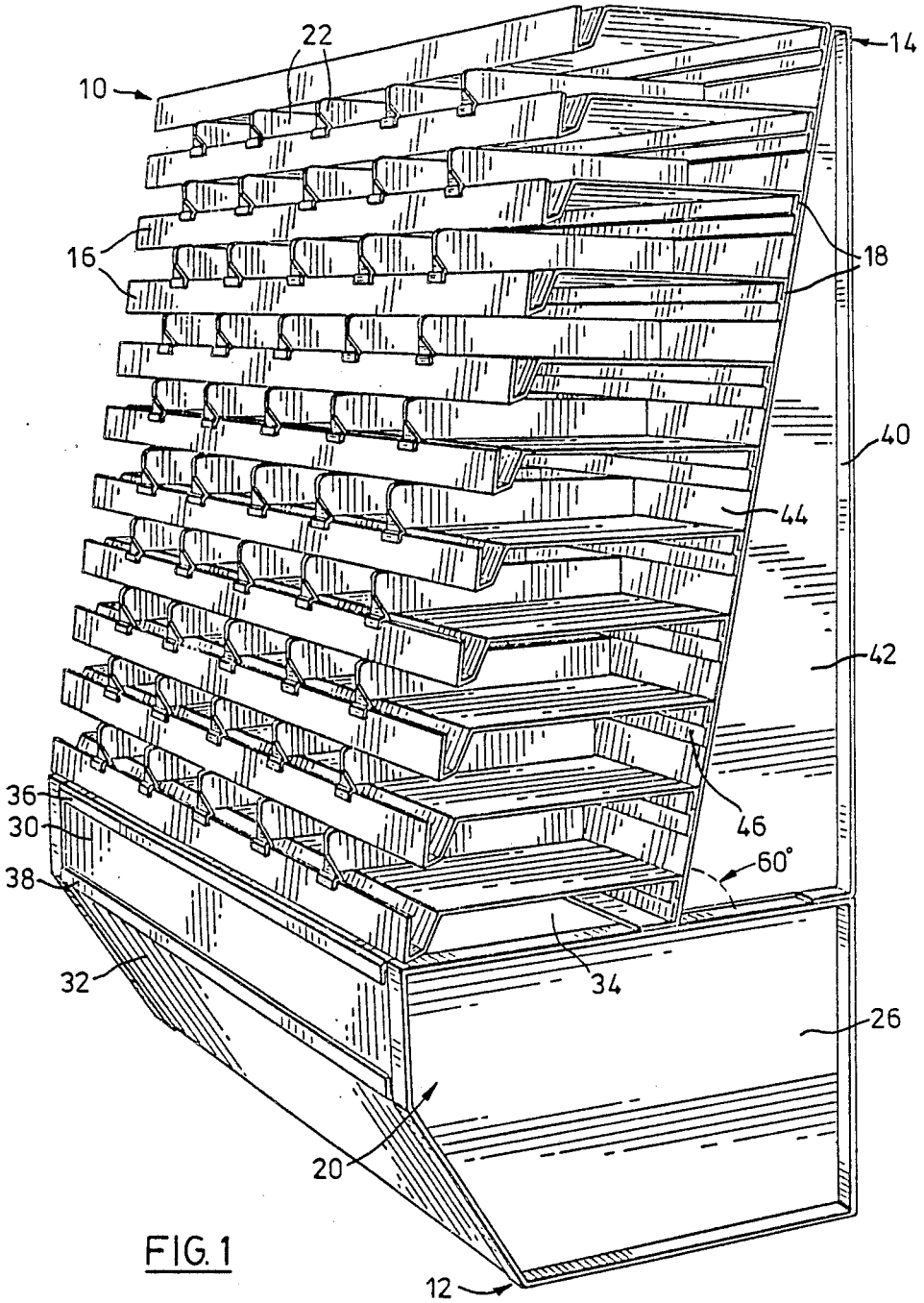
FIG. 1 is a perspective view of one preferred embodiment of the improved display and storage unit 10 constructed in accordance with the invention taken from a point upward and to the right of the front of the unit.

One preferred embodiment of the composite display and storage unit incorporating the invention is designated by 10 in FIG. 1 of the drawings.

The unit 10 includes a base portion or pedestal 12, an A-frame support structure 14 upstanding rearwardly on base portion or pedestal 12, a plurality of uniformly spaced-apart shelf-like modules 16 arranged in receding overlying or stepped relation project outwardly from said upstanding support structure 14 to which they are attached or anchored at 18 over the forwardly extending portion 20 of the base portion or pedestal 12 and a plurality of divider elements 22 extending inwardly between overlying spaced-apart shelf-like modules 16 which are likewise spaced apart to define pockets.

Base portion or pedestal 12 includes an inner supporting framework bounded by rear panel 24, end panels 26, 28, upper and lower front panels 30, 32 top panel 34 and bottom panel 35, which together define an enclosure which can be used for storage if desired for example by removing front wall panels 30, 32 and installing a drawer with requisite supports or tracks or other supporting structures therewithin or by installing doors to swing open and close to provide access to the interior thereof.

Lower front panel 32 is inclined inwardly and downwardly to not only contribute to the styling of the pedestal but serve as a recessed kickplate.

Upper front panel 30 is provided with opposed flanged elements 36, 38 to form a channel with front panel 30 for the reception of a colour strip of the like to compliment the decor, or for anchoring other indicia suitable for the particular circumstances and premises in which the unit is to be used.

Levelling guides not shown may be appropriately affixed to the framework to which bottom panel 35 is attached.

The A-frame support structure 14 upstanding rearwardly of base portion or pedestal 12 includes framing members 40 mounted at each end, folded upon itself with a like or other suitable framing or bracing support members located intermediately between end framing members 40 if required, to which an upright rear wall panel 42 and to which upwardly and rearwardly inclined wall panel 44 are secured and reinforced with struts or other bracing therealong where necessary.

According to the preferred embodiment illustrated in FIG. 1, attachment of the shelf-like elements or modules 16 to inclined front wall panel 44 at 18 is accomplished by securing folded strips of sheet metal 46 to the forward face of wall panel 44 in spaced-apart parallel rows extending from end to end of the unit. The upper flanges 48 of the metal strips 46 are offset from the lower flanges 50 and joined by an intermediate neck portion 52 to provide an upwardly opening recess or socket formation or anchoring station 54 extending therealong for the reception therein of the depending anchoring flanges 56 presented by the shelf-like modules 16 at their inner ends. The gauge of the depending anchoring flanges 56 and the width and the depth of the anchoring stations 54 are selected such that flanges 56 enter into the socket anchoring stations 54 in snug sliding fit and substantially fully register within such stations 54.

Thus it will be appreciated that shelf-like module 16 of the first embodiment is supported in cantelever-like fashion from its inner end through interengagement of its anchoring means or depending flange formation 56 with socket formation or anchoring station 54 presented by the inclined wall panel 44 of upstanding support structure 14.

The location of the anchoring strips 46 and the spacing therebetween upon inclined wall panel 44 will be governed in the case of the embodiment of FIG. 1 by the length or extent of the article such as a greeting card to be displayed in such unit, as will be later explained.

Moreover, by establishing the anchoring wall panel 44 to incline rearwardly at a selected angle of the order of between 60 degrees and 85 degrees, a disposition of the shelf-like elements to be releasably anchored thereto can be established for optimum viewing of the merchandise. In the embodiment shown in FIG. 1, this angle is 60 degrees.

Figure 2:
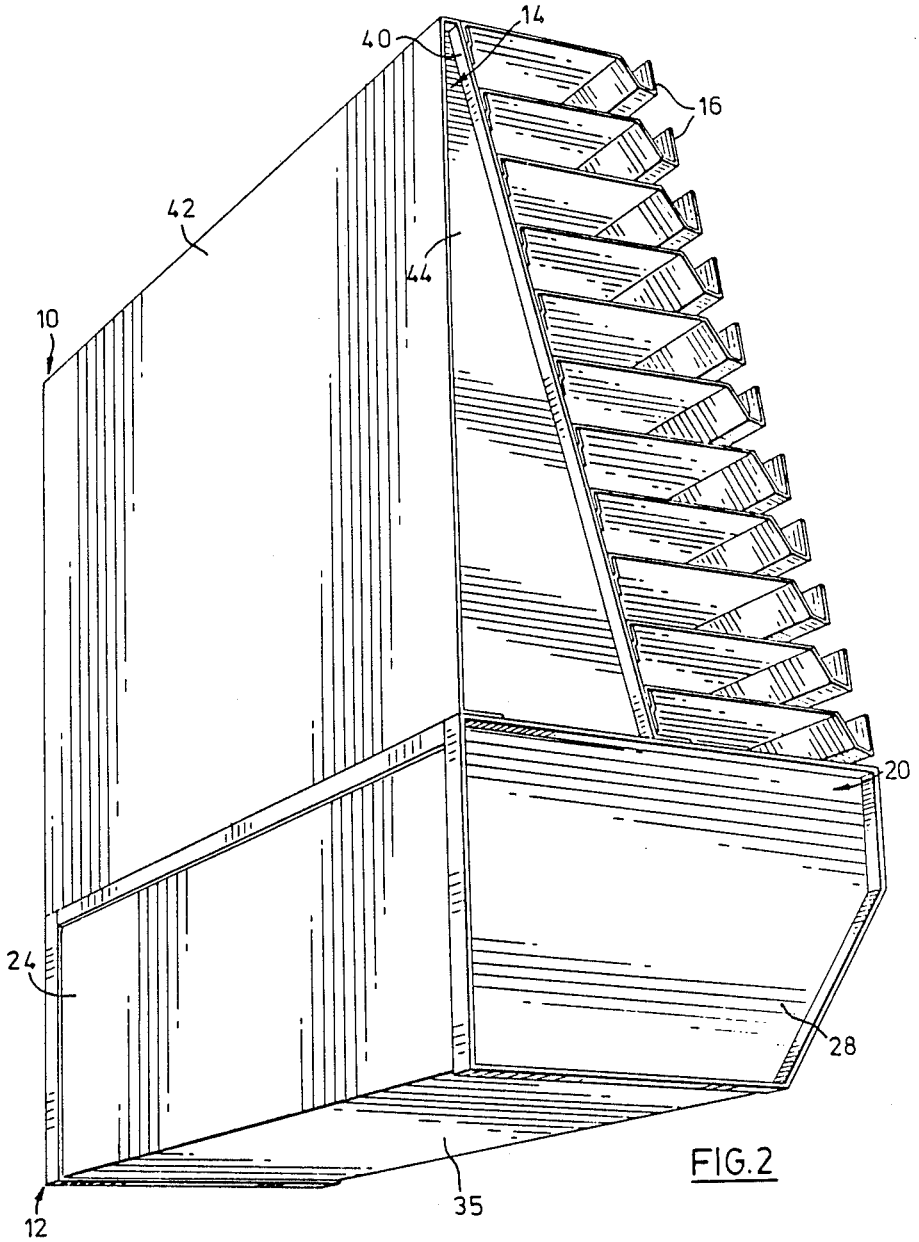
FIG. 2 is a perspective view of the embodiment of FIG. 1 taken from a point downward and to the right of the back of the unit.
Figure 3:
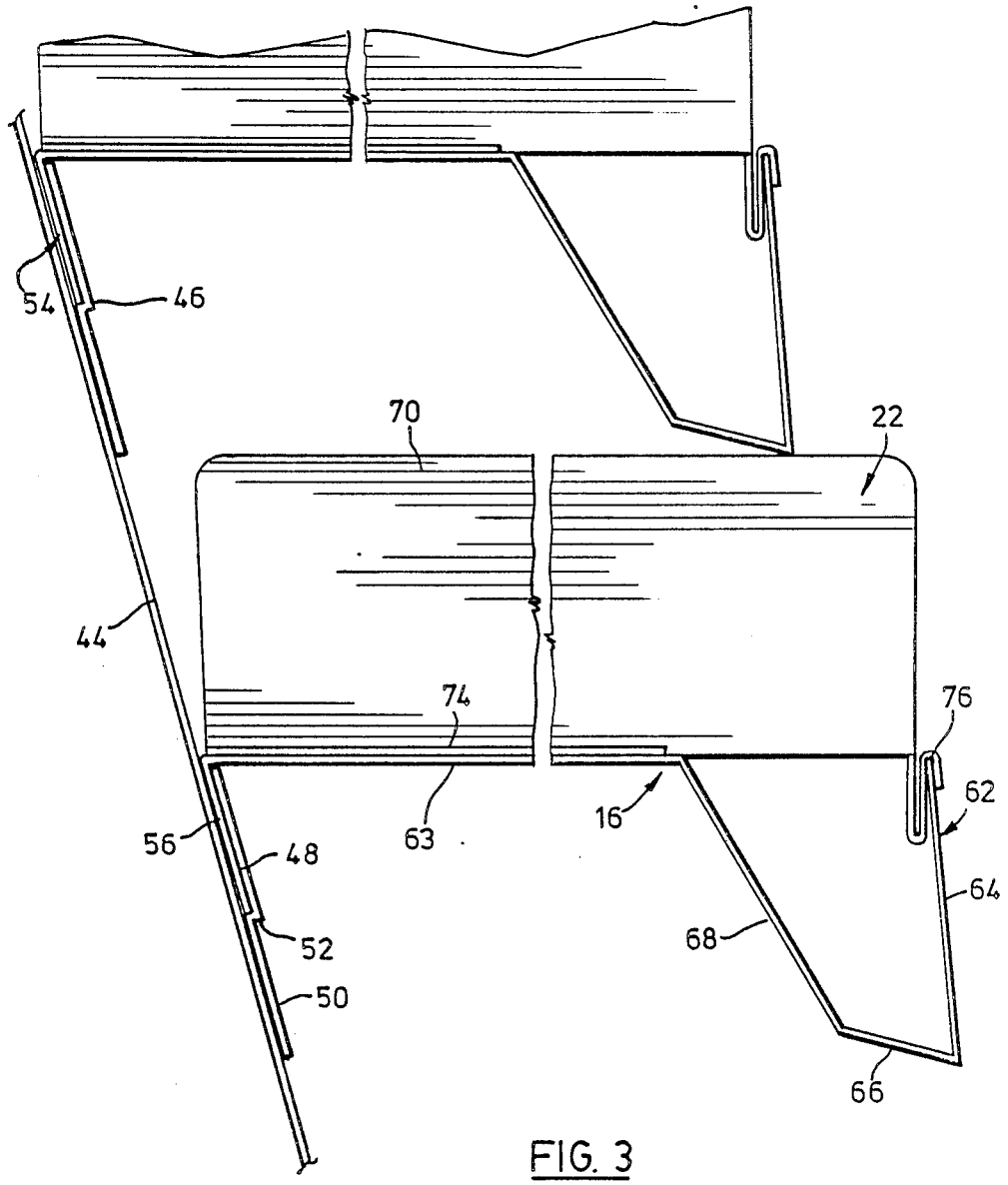
FIG. 3 is a side elevation of a divider element utilized in conjunction with the shelf-like elements of the preferred embodiment of FIG. 1 shown in broken line for purposes of illustration.

The particular shelf-like module 16 utilized in the preferred embodiment of FIGS. 1 and 2 are of the same dimensions and, as more particularly illustrated in FIG. 3, include a barrier means 62 foremost or at the outer end and the depending anchoring means or flange formation 56 innermost or at the inner end separated by a generally planar portion 63 in broken away construction constituting a repository for the backup inventory of merchandise.

The barrier means 62 of the module 16 is constituted by an integral outer flange section 64 extending upwardly and whose upper edge 65 is generally coplanar with the rearwardly extending repository portion 63 thereof.

Outer flange section 64 terminates lowermost in a section 66 which is slightly upwardly inclined and merges rearwardly with upwardly inclined section 68 so as to define a trough-like configuration which is adapted to receive a lower portion of a greeting card, for example, and retain same therein against accidental dislodgement.

By having established the shelf-like module 16 it will be observed that when such is anchored within the socket formation or anchoring station 54 presented by the upstanding upwardly and rearwardly inclined wall panel 44, each overlying module 16 is uniformly offset rearwardly so as to give a stepped appearance to the unit.

Figure 4:
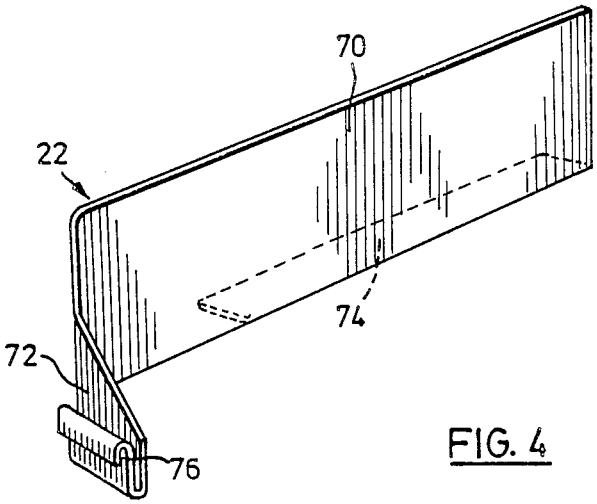
FIG. 4 is a perspective view of a divider element utilized in conjunction with the shelf-like elements of the preferred embodiment of FIG. 1.
Figure 5:
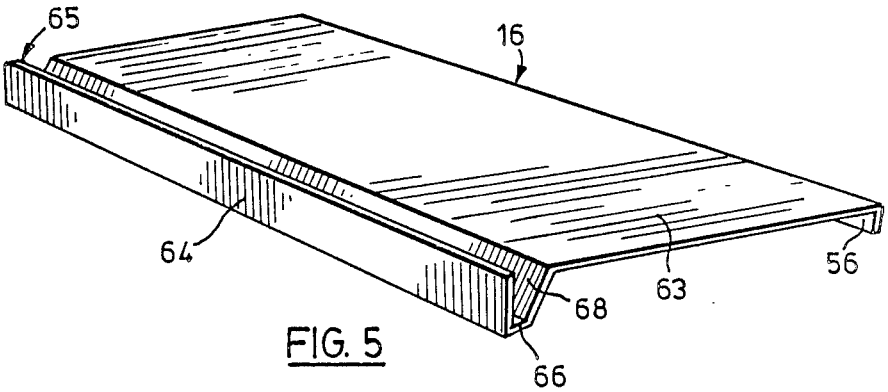
FIG. 5 is a perspective view of a shelf-like module revealed in the embodiment of FIG. 1.

Still further according to the embodiment of FIGS. 1 and 2 of the drawings, divider elements 22 are provided to segregate sections of the shelf-like element 16 and also to assist in supporting the overlying shelf-like element. The divider element 22 is best illustrated in FIG. 4, and comprises an upstanding planar portion 70 with a clip formation 72 foremost extending generally at right angles to planar portion 70 and a flange formation 74 extending longitudinally of said planar portion 70 and projecting outwardly from the lower edge thereof, shown in phantom lines in FIG. 4.

Clip formation 72 includes a recess portion 76 which is dimensioned so as to engage over the upper edge 65 of outer flange portion 64 of module 16 in snug sliding fit as shown in FIG. 3 so as to stabilize the divider element 22 with planar portion 70 extending vertically in any selected disposition throughout the longitudinal extent of shelf-like module 16.

Moreover, preferably divider element 22 has a vertical extent along its outermost edge that bridges the separation between the lower module and the barrier portion 62 of the overlying module so as to engage and support same when all the modules 16 are anchored in position, as revealed by FIGS. 1, 2 and 3, and serves to distribute the load when the unit is fully stocked.

More particularly, it will be observed from FIG. 1 that the lowest module 16 is so anchored within the socket formation 54 that the lowermost edge of the barrier portion 62 bears upon the upper surface of the base portion or pedestal 12 so that the load can be distributed over the extent of the base portion or pedestal 12.

Figure 6:
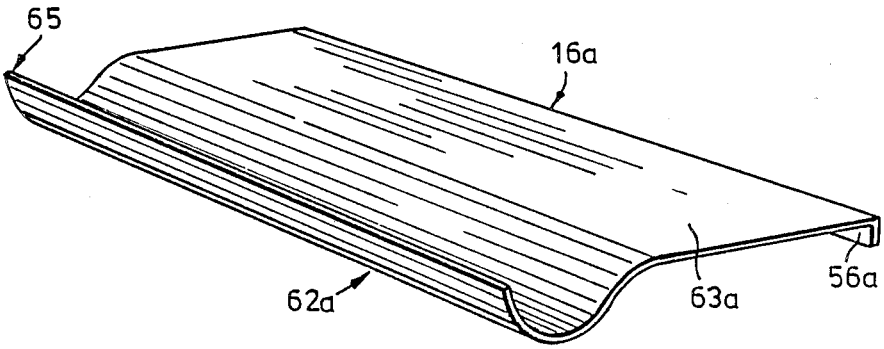
FIG. 6 is a perspective view of another preferred embodiment of the module suitable for the improved display and storage unit constructed in accordance with the invention.

In another embodiment, as illustrated in FIG. 6, the barrier portion **62*a* of the module 16*a* is constituted by a generally curvate trough-like formation which merges rearwardly with generally planar portion 63*a*. As in the first embodiment, an anchoring flange 56*a* depends from generally planar portion 63*a***. This embodiment is particularly adapted for display and storage of merchandise generally packaged as a roll or cylindrical tube, such as shelf paper and the like.

By anchoring the module **16*a* of this embodiment within the socket formation 54 so that the generally planar portion 63*a* inclines slightly downwardly toward the front, such merchandise disposed longitudinally along the length of module 16*a*** will self-deliver into the trough-like formation as items of merchandise are removed therefrom.

The same effect can be obtained where the generally planar portion **63*a*** is very slightly curvate downwardly toward the front.

Figure 10:
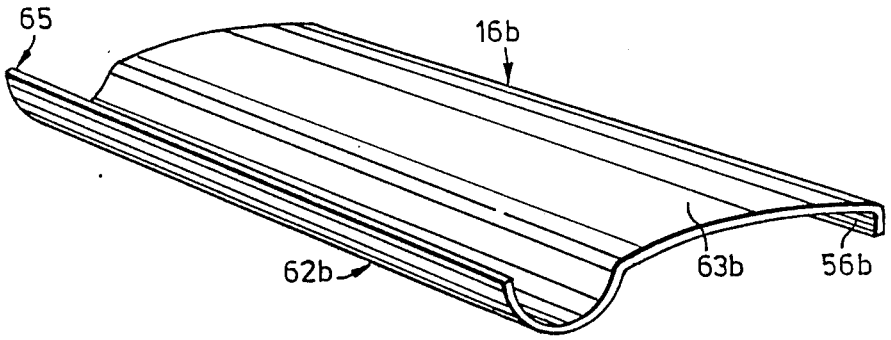
FIG. 10 is a perspective view of another embodiment of the shelf-like module used in the embodiment of the unit of FIG. 1.

For example, in FIG. 10 the barrier portion **62*b* defines a generally curvate trough-like configuration with which the intermediate repository portion 63*b* of module 16*b* defining a slightly upward curviture for storage of rolls of paper and the like which are subsequently dispensed into barrier portion 62*b***.

Figure 11:
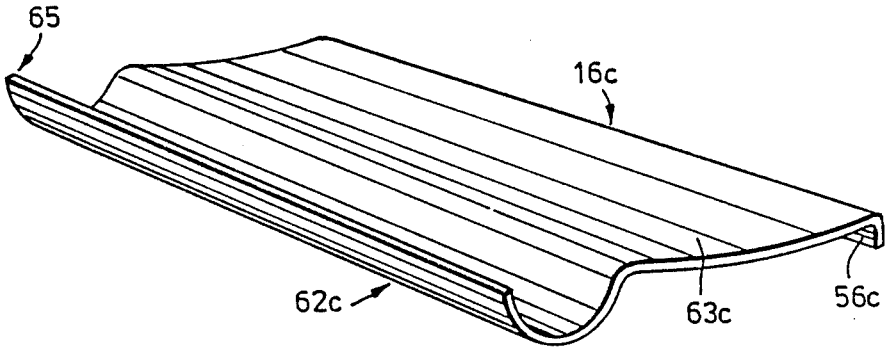
FIG. 11 is a perspective view of yet another embodiment of the shelf-like module used in the embodiment of the unit of FIG. 1.

In FIG. 11 another embodiment of the shelf-like module is shown wherein the intermediate repository portion **63*c* defines a slightly downward curviture. This can be used for example with rolls which the merchandiser wishes to retain in the storage area instead of dropping forward into an empty barrier portion 62*c***.

The divider element in FIG. 4 is preferably utilized in the same manner as described above but slightly altered to accommodate the changes in configuration or outline.

Figure 7:
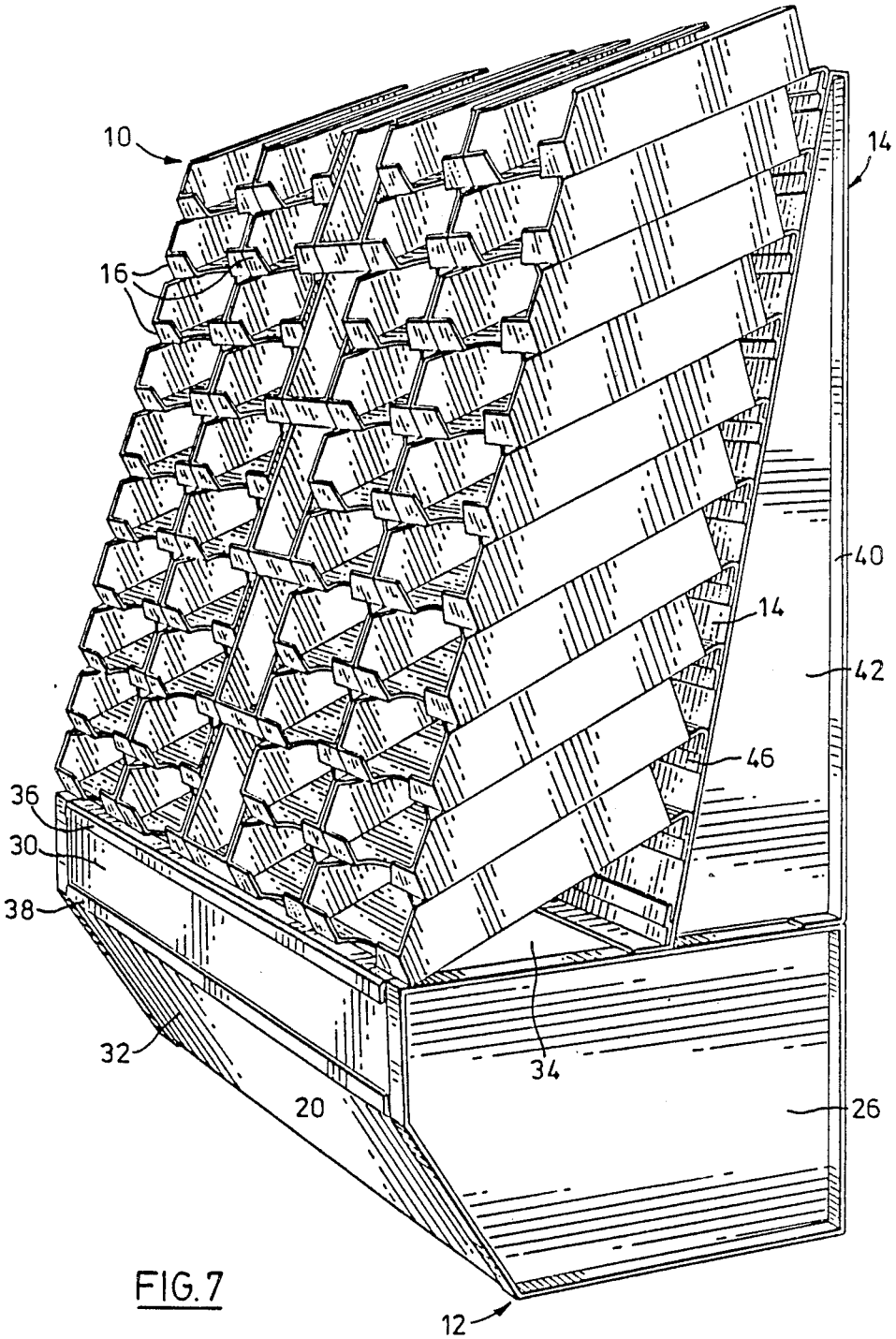
FIG. 7 is a perspective view of still another preferred embodiment of the improved display and storage unit constructed in accordance with this invention from a point forward and to the right of the unit.

A still further embodiment of the composite display and storage unit is illustrated in FIG. 7.

Figure 8:
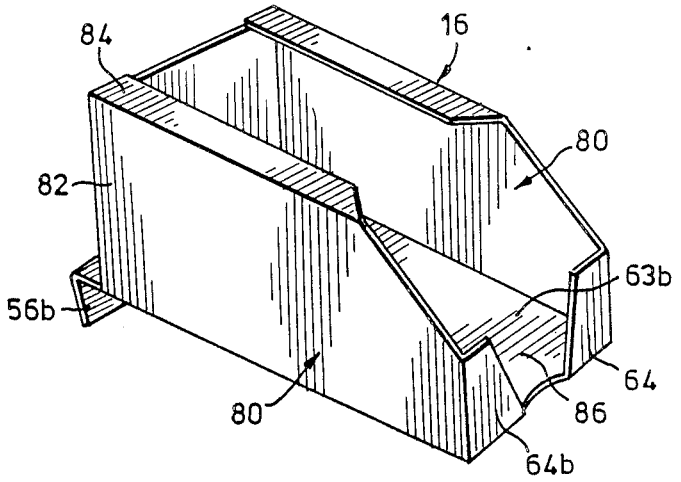
FIG. 8 is a perspective view of a shelf-like module used in the embodiment of the unit of FIG. 7.

The shelf-like module 16 of this embodiment, as best illustrated by FIG. 8, comprises an outer barrier **64*b*, a generally planar portion 63*b* constituting a repository for merchandise extending inwardly therefrom, an inner anchoring flange formation 56*b* and divider elements 80 comprising an upstanding planar portion 82 extending upward from the side edges of generally planar portion 63*b* terminating in a flange formation 84 extending generally at right angles to planar portion 82 and projecting inwardly from the upper edge thereof. The outer barrier 64*b* may have a recess 86 which may extend into a front portion of generally planar surface 63*b* as illustrated in FIGS. 8 and 9**, to facilitate the removal of merchandise therefrom.

This embodiment is particularly well suited for display and storage of merchandise such as sheets of wrapping paper generally packaged in flat form but lacking the rigidity to incline upwardly without contiguous support.

Figure 9:
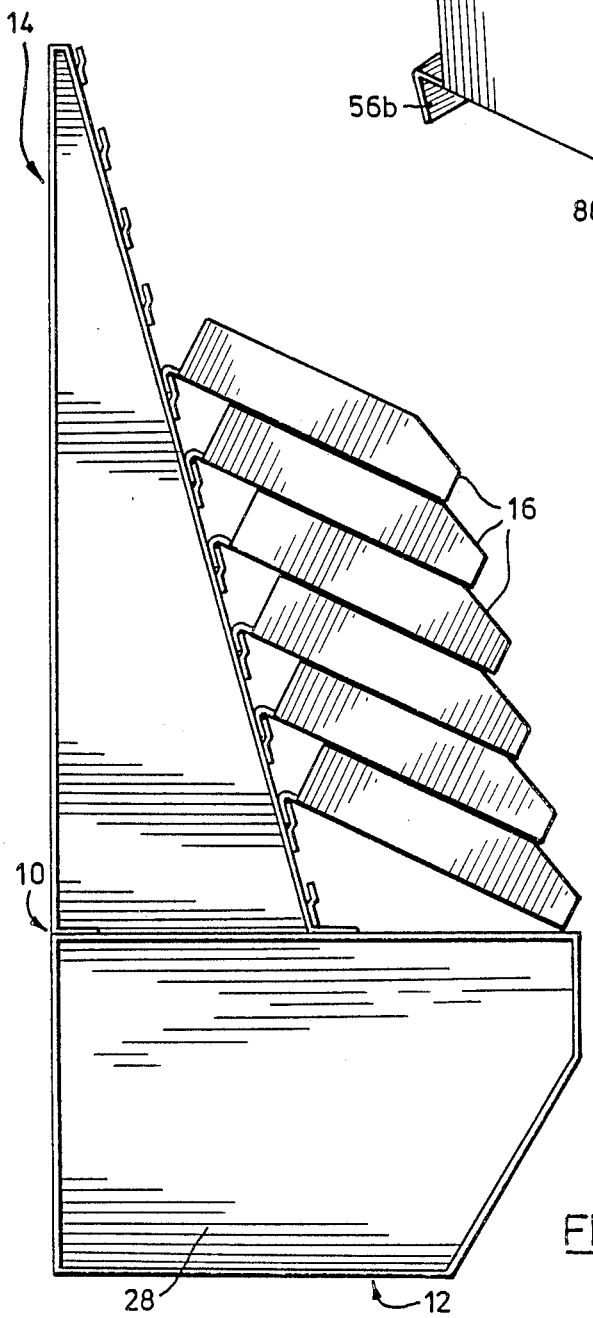
FIG. 9 is a side elevational view taken from the left side of the improved composite display and storage unit of FIG. 7.

To compensate for the orientation of merchandise in this embodiment the anchoring flange formation **56*b* of the lowermost module 16 may be mounted to engage the second or third lowermost socket formation 54 as illustrated in FIGS. 7 and 9. The resulting increased incline has been found to render merchandise in module 16** more readily visible and accessible.

FIG. 7 illustrates a manner in which the composite display and storage unit may utilize modules of differing shape and proportions. Modules in the central column illustrated in FIG. 7 differ from those in other columns. Other combinations of modules will be obvious to those skilled in the art, and this invention is intended to cover all such combinations.

While specific embodiments of this invention have been illustrated and described herein, the invention is not limited to the specific constructions herein disclosed. Those persons skilled in the art may be able to devise modifications in or alternatives to the disclosed structural features while still practicing this invention, and it is intended that the appended claims cover all such modifications and alternatives, as well as other embodiments not disclosed, which do not constitute a departure from the spirit and scope of this invention.

I claim:

1. In a module for the combined display and storage of merchandise, which is adapted for attachment to an upstanding support formation to project outwardly therefrom, an inner end portion including anchoring means for attachment to said support formation and an outer end portion including barrier means for confining merchandise thereto for display and inspection, and an intermediate repository portion for supporting merchandise thereon for storage and extending above said barrier means from said outer end portion towards said inner end portion and accessible from said outer end portion.

2. A module according to claim 1 wherein said outer end portion has an upwardly opening trough-like configuration extending generally at right angles to the direction of the projection of said module outwardly from said support formation and including an upstanding wall portion spaced outwardly from said repository portion constituting said barrier means.

3. A module according to claim 2 wherein said upwardly opening trough-like configuration of said outer end portion is defined by a plurality of generally planar wall portions including said upstanding wall portion which depend below said repository portion outwardly thereof.

4. A module according to claim 2 wherein said upwardly opening trough-like configuration of said outer end portion is defined by at least three generally planar wall portions including said upstanding wall portion, an inner wall portion extending downwardly from said repository portion, and a bottom wall portion extending between said upstanding wall portion and inner wall portion in the region below and outwardly of said repository portion.

5. A module according to claim 4 wherein said bottom wall portion is inclined outwardly and downwardly from said inner wall portion towards said upstanding wall portion.

6. A module according to claim 2 wherein said trough-like configuration of said outer end portion is generally downwardly curvate.

7. A module according to any one of claims 1 to 6 inclusive wherein said repository portion is of a generally planar configuration.

8. A module according to any of claims 1 to 6 inclusive wherein said repository portion is of a generally upwardly curvate configuration from said outer end portion towards said end portion.

9. A module according to claim 3 wherein the uppermost extent of said barrier means does not exceed that of said repository portion.

10. A module according to any of claims 1 to 6 inclusive wherein said anchoring means of said inner end portion includes flange means projecting downwardly therebelow.

11. In a module for the combined display and storage of merchandise, which is adapted for attachment to an upstanding support formation to project outwardly therefrom, an inner end portion including anchoring means for attachment to said support formation and an outer end portion including barrier means for confining merchandise thereto for display and inspection, and an intermediate repository portion for supporting merchandise thereon for storage and extending from said outer end portion towards said inner end portion and accessible from said outer end portion, a peripheral wall formation including opposed side walls and opposed inner and outer end wall portions upstanding from said outer end portion and said repository portion so as to substantially surround same with said outer end wall portion constituting said barrier means.

12. A module according to claim 11 wherein said opposed side wall portions of said peripheral wall formation upstanding from said repository portion have a uniform height and include opposed flange formations uppermost extending inwardly over said repository portion and in uniformly spaced apart relation therebove with said latter mentioned opposed side wall portions of said repository portion exceeding both the height of said opposed side wall portions upstanding from said outer end portion and said outer end wall portion whereby said repository portion is accessible over said outer end portion.

13. A module according to claim 12 wherein said opposed side wall portions of said peripheral wall formation upstanding from said outer end portion gradually decrease in height from their juncture with the opposed side wall portions upstanding from said repository portion towards their juncture with said outer end wall portion.

14. A module according to claims 11, 12 or 13 wherein said repository portion and outer end portion are coplanar.

15. A module according to claims 11, 12 or 13 wherein said outer end wall portion has aperture means therethrough.

16. A module according to claims 11, 12 or 13 wherein said anchoring means of said inner end portion includes flange means projecting downwardly therebelow.

17. In a unit for the combined display and storage of merchandise which is adapted for attachment to an upstanding support formation to project outwardly therefrom, the combination with a module having an inner end portion including anchoring means for attachment to said support formation and an outer end portion including barrier means for confining merchandise thereto for display and inspection and an intermediate repository portion for supporting merchandise thereon for storage extending from said outer end portion towards said inner end portion and accessible over said outer end portion, divider means adapted to extend inwardly from said outer end portion over said repository portion and to upstand therefrom in an aligned position therewith and shiftable thereover throughout a range of upstanding aligned positions, and means presented by said divider means to said module for releasably engaging said module for maintaining said divider means in said upstanding aligned positions thereover and guiding same when shifted throughout said range of aligned positions.

18. A unit according to claim 17 wherein said outer end portion of said module has an upwardly opening trough-like configuration including an upstanding wall portion uniformly spaced outwardly from said repository portion constituting said barrier means extending generally at right angles to the direction of the projection of said module outwardly from said support formation.

19. A unit according to claim 18 wherein said means presented by said divider means for releasably engaging said module includes channel means extending generally at right angles to the direction of projection of said module outwardly from said support formation and opening downwardly to engage in snug sliding fit over the uppermost extent of said upstanding wall portion constituting said barrier means whereby said divider means is maintained in said aligned positions and is guided when shifted throughout said range of aligned positions.

20. A unit according to claim 19 wherein flange means is carried by said divider means to extend generally at right angles to the plane thereof and lowermost to overlie and contact said repository portion so as to stabilize same when disposed in one of said range of aligned positions.

21. In a display and storage unit, an upstanding upwardly and rearwardly inclined support formation, said support formation presenting horizontally aligned and uniformly vertically spaced apart anchoring stations for the attachment of a support therefrom of modules for the combined display and storage of merchandise thereon in cantilever-like fashion, each such module including an inner end portion including anchoring means engageable with said anchoring stations to project outwardly therefrom and an unsupported outer end portion including barrier means for confining merchandise thereto for display and inspection and an intermediate repository portion for supporting merchandise thereon for storage extending above said barrier means from said outer end portion towards said inner end portion and accessible over said outer end portion.

22. A module according to any one of claims 1 to 6 inclusive wherein said anchoring means of said inner end portion includes flange means projecting downwardly therebelow at an acute angle to said repository portion.

23. A module according to claims 11, 12, or 13, wherein said anchoring means of said inner end portion includes a flange means projecting downwardly therebelow at an acute angle to said repository portion.

* * * * *